US009333741B2

(12) United States Patent
Nick et al.

(10) Patent No.: US 9,333,741 B2
(45) Date of Patent: May 10, 2016

(54) METHOD AND ARRANGEMENT FOR PRINTING A THREE-DIMENSIONAL SURFACE

(71) Applicant: KHS GmbH, Dortmund (DE)

(72) Inventors: Michael Nick, Dortmund (DE); Katrin Preckel, Gelsenkirchen (DE); Werner Van de Wynckel, Humbeek (BE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 14/387,918

(22) PCT Filed: Mar. 21, 2013

(86) PCT No.: PCT/EP2013/000857
§ 371 (c)(1),
(2) Date: Sep. 25, 2014

(87) PCT Pub. No.: WO2013/143668
PCT Pub. Date: Oct. 3, 2013

(65) Prior Publication Data

US 2015/0085006 A1 Mar. 26, 2015

(30) Foreign Application Priority Data

Mar. 26, 2012 (DE) ..... 10 2012 005 924

(51) Int. Cl.
*B41J 29/38* (2006.01)
*B41F 17/28* (2006.01)
*B41J 3/407* (2006.01)

(52) U.S. Cl.
CPC ..... *B41F 17/28* (2013.01); *B41J 3/4073* (2013.01)

(58) Field of Classification Search
USPC ..... 347/12, 101, 14, 41
See application file for complete search history.

(56) References Cited

U.S. PATENT DOCUMENTS

| | | | | |
|---|---|---|---|---|
| 6,538,767 | B1 | 3/2003 | Over et al. | |
| 7,740,349 | B2 * | 6/2010 | Tezuka et al. | 347/101 |
| 2001/0017085 | A1 | 8/2001 | Kubo et al. | |
| 2005/0195229 | A1 | 9/2005 | Barss | |
| 2005/0248618 | A1 | 11/2005 | Pinard et al. | |
| 2007/0291060 | A1 * | 12/2007 | Aruga | 347/12 |

FOREIGN PATENT DOCUMENTS

| | | |
|---|---|---|
| DE | 102005060785 | 6/2007 |
| DE | 102006034060 | 1/2008 |
| DE | 102010001120 | 7/2011 |
| GB | 2 376 920 | 12/2002 |
| JP | H05 318715 | 12/1993 |
| JP | 2001191514 | 7/2001 |
| JP | 2004 082442 | 3/2004 |
| JP | 2006 335018 | 12/2006 |
| JP | 2006 335019 | 12/2006 |
| WO | WO 2004/016438 | 2/2004 |

* cited by examiner

*Primary Examiner* — Lam Nguyen
(74) *Attorney, Agent, or Firm* — Occhiuti & Rohlicek LLP

(57) ABSTRACT

A method of printing includes using a printing head that comprises straight parallel rows of printing nozzles to print a printed image on a surface of a conically rotationally symmetrical region of an outer wall of an object by controlling parallel rows of printing nozzles taking into account pixel density to be achieved in the printed image, setting a printing density of a printing nozzle with regard to at least one reference parameter, and setting a variable offset between a pair of the rows based on a change in relative speed between the printing head and the conically rotationally symmetrical region of the object.

22 Claims, 5 Drawing Sheets

METHOD AND ARRANGEMENT FOR PRINTING A THREE-DIMENSIONAL SURFACE

RELATED APPLICATIONS

This application is the national stage entry under 35 USC 371 of PCT application PCT/EP2013/000857 filed on Mar. 21, 2013, which claims the benefit of the Mar. 26, 2012 priority date of German application DE 10 2012 005 924.8, the contents of which are herein incorporated by reference.

TECHNICAL AREA

The present invention relates to a method and arrangement for printing on a three-dimensional surface.

BACKGROUND TO THE INVENTION

To apply a printed image onto a flat surface, it is necessary for the printing head and a substrate, the surface of which is to be printed, to be moved relative to each other at a constant speed. On the one hand, the printing head can be moved over the flat surface, and on the other, it is also possible to move the flat surface in front of a static printing head. The synchronization between the printing head and the particular linear drives takes place by high-resolution rotary encoders on the particular linear drives, wherein each pulse triggers the ink discharge of an entire column of the print sequence.

The application of the printed image can be transferred from flat surfaces to cylindrical rotationally symmetrical bodies. Moreover, a cylindrical surface and a, for example, vertically arranged printing head are rotated axially relative to each other. Through a constant angular velocity, the surface moves at a constant speed relative to the printing head or vice versa. In this case, pulses of a rotary encoder of a rotary drive trigger the printing of one line of the printed image.

SUMMARY OF THE INVENTION

Against this backdrop, a method and an arrangement with the characteristics of the particular independent patent claims are presented. Other embodiments of the invention arise from the dependent patent claims and the description.

With the method and the arrangement, printing on rotationally symmetrical objects, which are generally made as containers, is possible by source image preparation in the form of a line correction (image processing). The invention can be used in the area of packaging solutions with label-free containers and/or for direct printing onto containers.

Thus, an image correction and/or printed image control for non-cylindrical containers, for example non-cylindrical bottles, is possible. With the invention, a diverging of perpendicular pixel lines and a linear increase in the pixel density with increasing circumference are compensated for. This relates, in particular, to the use of printing heads with a plurality of rows of printing nozzles.

In addition, patterns are adapted to the format of the object to be printed on, whereby an offset or shift between the two rows of printing nozzles of the printing head is compensated for, whereby the latter is designed on, for example, a maximum reference circumference of the region of the object to be printed on. The same applies for the physical pixel density.

With software functions, a printed image adaptation to generally rotationally symmetrical shapes of objects, for example bottles, can be carried out, wherein a line shift is compensated for. This is made possible by providing variable offsets of individual printing nozzles, a variable pixel density, and a color separation. Moreover, it is also possible to input a shape of the bottle or the container. In particular, using software functions, it is possible to input all shapes, including, for example, conical and curved shapes, grooves etc. from technical drawings and to store them appropriately.

A positioning of the printing head corresponding to an angle of inclination, a height, a distance, and the format of the printed image is transferred to a printing machine.

One application of the invention is possible in prepress management software and thus takes place one step before the printing process. In this case, patterns of the printed image and control and/or positioning data are prepared for the printing machine.

In the context of the invention, a digital printing method, for example for an inkjet printer, with a control and software for technical software-based correction and/or adaptation of a digital artwork master to the current shape of a rotationally symmetrical surface of an object is carried out. By the application of software, the offset between at least two rows of printing nozzles of at least one printing head is adapted to the particular diameter of the region and a pixel density.

In this regard, printing tracks that are to be repositioned and oriented are not needed for curved surfaces. Instead only one printing sequence and a single orientation of the printing head are provided. This means that the printing head is to be positioned just once relative to the area to be printed on. During a rotation of the object by 360° maximum, the region covered by the printing head can be completely printed on with the printed image. Consequently, during a printing sequence, the printed image can be applied in full in an axial and/or horizontal direction. In general, within a movement of a container, a complete printed image is applied by at least one printing head.

With the method, CAD data can be used, over and above the positioning of the printing head, also for image processing, i.e. positioning of the ink droplets and/or adaptation of the droplet size.

Thus, a software-supported, automated prepress management and an image preparation of direct printing applications on rotationally symmetrical surfaces are possible, whereby the printed image is adapted to same with the image-processing prepress management.

The method can be carried out in an embodiment with inkjet printing technology. In the "drop-on-demand" method, which can also be used, ink is applied on the substrate to be printed on, i.e. the region of the object, only upon request. Moreover, ink droplets are positioned precisely on the substrate by the nozzles of the printing head. For this purpose, it is possible to use both bubble-jet printing heads, which deposit ink droplets by generating an air bubble in the nozzles of the printing head, and also piezo printing heads, which eject ink droplets by distortion of piezoelectric ceramic elements in the nozzles of the printing head. Piezoelectric printing heads are usually used because, in contrast to bubble jet printers, it is possible to control the volume of ink droplets by controlling the voltage pulses. In addition, piezoelectric printing heads work at a higher frequency that bubble jet printers and have a longer service life.

The printing head used for the development of the image preparation can support up to a thousand active printing nozzles and generate seven-stage droplet sizes between 6 and 42 picoliters. This corresponds to eight grey stages. In some embodiments, the printing head achieves a physical pixel density of 360 dpi. Due to the dynamic eight grey stages, this corresponds to an optical resolution of 1080 dpi.

To achieve this high resolution, the printing nozzles are arranged in two vertically offset rows of 500 nozzles each. The printing nozzles of the two rows are offset horizontally to each other lie at the same distances to each other. Only the combination of both rows allows the resolution of 360 nozzles per inch with a vertical pixel distance of 70.556 micrometers. The distance between the rows of printing nozzles stands at 4.798 millimeters. If the printing head moves at a constant relative speed to the substrate to be printed, the ink discharge of the second row of printing nozzles is delayed by a constant time offset. This delay compensates for the distance between the rows of printing nozzles so that droplets of both rows of printing nozzles combine to form one line.

To supply the printing head continuously, an ink-supply system is used. The ink-supply system conditions the ink through-flow rate, the temperature, and the precise pressure of the ink at the printing nozzles of the printing head.

To apply the printed image, for example on the conically rotationally symmetrical surface, the vertical axis of the printing head is oriented parallel to the secant of the outer points of the printing region of the surface so that the latter is arranged approximately parallel to the surface and positioned corresponding to the next possible contact point, for example at a 1 millimeter distance at the height of the next possible contact point. A rotary drive then rotates the object or body before the inclined printing head. A rotary encoder, which triggers the rotation of the object, also activates the printing sequence of one line of the printed image during which ink is applied on the surface. To make use of the entire physical resolution of the printing head, both rows of printing nozzles are used. By means of a bottle cross-section calculated from CAD data, parameters can be determined at the height of each individual printing nozzle, for example the diameter and angle of inclination to the adjacent printing nozzle, which together describe the rotationally symmetrical print region and can be used to adapt the offset of individual printing nozzles and the pixel density of individual rows in the printed image.

To examine algorithms and methods devised for this, a drive unit for moving the container, a printing technique for printed image application, and a lighting unit for drying the ink applied can be used as possible components of the arrangement according to the invention.

To directly print a rotationally symmetrical object, for example a container, a drive unit is used with which the object is axially rotated at a constant speed in front of the printing head. The drive unit provided for this comprises a spike and a ball-bearing mounted plate between which the object is clamped. A direct current geared motor finally drives a drive axis connected to the spike. The rotary movement is transferred by friction from the spike onto the clamped object. A rotary encoder transmits TTL signals of the rotary increments to the control unit of the printing head. In this way, it is ensured that printing of a line of the printed image is triggered at regular rotational distances.

The printing head is oriented and/or positioned onto the rotation axis of the drive unit by a bracket, wherein a distance and an angle of inclination to the object is set.

To cure the applied ink, there is a water-cooled LED UVA lighting unit over the printing head. If UV-cured ink is used, it is used for pinning and curing. Due to polymerization, long chains of molecules form and a strong insoluble layer arises.

The method can be carried out, for example, for a container made in the form of a bottle. This bottle has a conical rotationally symmetrical region for a tag or label with an angle of inclination of around 3°. The application of the printed image is adapted to a conical rotationally symmetrical surface. Patterns, for example in bitmap file format, are used to develop a suitable image preparation. A tag or label region of this bottle comprises a conical rotationally symmetrical body with the following properties:

Maximum diameter=68.5 mm
Minimum diameter=61.0 mm
Maximum difference between diameters=7.5 mm
Height of the label region=71.0 mm
Angle of inclination=3.015°

With a resolution of 3050*1000 pixels, the image format of the printed image is adapted to the maximum circumference of the bottle of 215.199 millimeters and to the height of the label region of 71 millimeters. A correlation between the dimensions of the image format and the resolution is set out below.

$$360\ \text{dpi}*215.119\ \text{mm}*(25.4\ \text{mm/inch})^{-1}=3050\ \text{pixels}$$

$$1000\ \text{pixels}*25.4\ \text{mm/inch}/360\ \text{dpi}=70.56\ \text{mm}$$

The image data contain RGB color information for the application of a multi-color print, and 8-bit gray stage values for application with just one ink color.

If the printed image with an angle of inclination of the printing head of 3° is applied onto the bottle without image preparation, ink drops of offset rows of nozzles of the printing head, in this case the second row of nozzles, are applied with a decreasing bottle circumference shifted against the direction of rotation, and perpendicular columns diverge by half-lines with a decreasing bottle diameter.

By adapting the horizontal pixel density to the height of the maximum circumference, the path increments change proportionally at a constant printing frequency due to a change in circumference. The physical pixel density thus increases as the bottle circumference decreases.

Both effects can be traced back to the structural shape of the printing head. The ink droplets, which come from two rows of printing nozzles, combine at a constant relative speed between the printing head and the substrate to form one printed line. The non-constant bottle circumference is likewise critical.

To compensate for the physical offset of the two rows of printing nozzles, the ink discharge of the second row of printing nozzles is delayed by the printing head control by means of a constant time offset. This is provided so that pixels from the two rows combine to form a line. If the substrate moves under the entire printing region at a constant speed relative to the printing head, this approach leads to the desired printed image.

If the conically rotationally symmetrical bottle shape used rotates at a constant angular speed, the relative speed between printing head and substrate corresponding to the circumferential speed is proportional to the change in circumference. Designed for a reference circumference, for example the maximum bottle circumference, the constant time offset between the two rows of printing nozzles of the printing head is set. The ink droplets applied by the two rows of printing nozzles combine to form a line in this region. The change in the relative speed, k, which is caused by a change in circumference, acts proportionally on the constant time offset between the rows of printing nozzles in a physical offset.

$k(i)=(\max(U_{max}*f_p)-(U(i)*f_p))*(70.556\ \mu m)^{-1}$, where $f_p$=printing frequency, and U(i)=circumference at height of printing nozzle i. A non-constant offset thus arises.

In a possible embodiment of the method, a correlation between an offset of two or more rows of printing nozzles and of the bottle circumference at the height of each individual printing nozzle is taken into account.

Every second line of the printed image thus has the non-constant physical shift or offset corresponding to its difference between local relative speed and reference speed, for example at the height of the maximum bottle circumference.

To achieve the highest physical pixel density possible, the printed image is adapted to the maximum circumference of the bottle. While in this region, a both vertically and also horizontally constant physical pixel density of 360 dpi is set, with a smaller bottle circumference and constant printing frequency, caused by a constant angular speed, due to shorter completed path increments between the triggering of two printing pulses, this leads to a higher horizontal physical pixel density. If the pixel density at the height of the smallest bottle diameter is calculated, with 3050 printed lines with a minimum circumference of 191.637 millimeters, a physical pixel density of 404 dpi arises, which corresponds to an increase of 44 dpi:

$$3050 \text{ pixels}*25.4 \text{ mm/inch}*(191.637 \text{ mm})^{-1}=404 \text{ dpi}$$

In a possible embodiment of the method, a correlation between the pixel density and the bottle circumference at the height of each individual printing nozzle is taken into account. To carry out the method, an adaptation of the source image data to the described surface is undertaken, wherein source image data comprises patterns and also a file format to describe the substrate surface, in particular as a vector or pixel graphic, and a digital technical drawing (CAD). For this, a shape-descriptive contour is saved for each individual printing nozzle or row of printing nozzles of the printing head. Geometric parameters, for example bottle diameter and circumference, angle of inclination, etc. of the region to be printed (label area), are taken from this. Vectors arise with the dimension n, wherein n represents the number of active printing nozzles. These vectors contain particular aforesaid bottle parameters for n printing nozzles. Each element v(i) describes the bottle cross-section at the height of a printing nozzle i, and combined, the vector v describes the entire printing region. Moreover, a description of the shape of the described surface as an approximated function is possible.

In addition, it is provided for the non-constant half-line offset and also the change in the physical pixel density to be adapted according to a change of circumference by means of image processing of the source image file of the printed image.

With the method, patterns to be produced and stored digitally for the application of the printed image on non-cylindrical, conical, curved or other rotationally symmetrical three-dimensional objects or bodies are adapted to the shape of the surface. This approach is distinct from other known methods due to the omission of tracks and the associated repositioning of the printing head during a printing process, in favor of a single printing sequence that accommodates the design for an output-oriented production line. Moreover, a technical control hardware expense for controlling individual printing nozzles is not needed.

The adaptation by means of image processing comprises a correction of a non-constant physical offset caused by a change of relative speed. For this, the described offset o is first calculated for each individual printing nozzle of an offset row of printing nozzles.

$$k(i)=(\max(U\max*fp)-(U(i)*fp))*(70.556\ \mu\text{m})^{-1}o(i)=k(i)+\text{offset_const}$$

If this offset exceeds the pixel distance at a resolution of 360 dpi of 70.556 micrometers or by a multiple of this value, all the pixels of the corresponding pixel line in the current pattern are shifted in the printed image by one pixel or a multiple thereof against the physical offset. A stage function arises which approximates a continuous offset change. Shifted pixels are treated chronologically earlier in the printing process. As affected ink drops in a printed line are triggered chronologically earlier, the physical offset is reduced and the change in the relative speed is compensated. Furthermore, adjacent pixels in a line of the pattern can be included as a combination by including a weighting for the proportional shifting of pixels by affecting the drop size, in particular for representing text and large-area motifs in the pattern.

The physical pixel density changes relative to the circumferential change in the surface. By means of image processing, the change in the physical pixel density is adjusted by adaptation of the optical resolution. To this end, the pixel density is calculated for each individual printing nozzle by means of the printing frequency and the circumference. Moreover, the pattern is split into its color components, in particular cyan, magenta, yellow and black, not ruling out other special colors. (The following steps are carried out in the particular color components.) The values of all the pixels in a line of one color component of the pattern are reduced by means of the percentage change in pixel density. If, because of this change, pixels overstep a threshold of the quantification of the printing head control in eight gray steps (corresponding to drop sizes), the optical pixel density is adapted. This approximation can be optimized by including adjacent pixels in a line such that in addition, for quantification, a weighting can be carried out by means of contiguous pixels.

The arrangement according to the invention is made to carry out all the steps in the method presented. Moreover, individual steps of this method can also be carried out by individual components of the arrangement. Furthermore, functions of the arrangement or functions of individual components of the arrangement can be implemented as steps of the method. In addition, it is possible for steps of the method to be implemented as functions at least of one component of the arrangement or of the entire arrangement.

In one aspect, the invention features a method of printing on a conical portion of a bottle. Such a method includes using a printing head that has straight parallel rows of printing nozzles to print a printed image on a surface of a conically rotationally symmetrical region of an outer wall of an object. The conically rotationally symmetrical region is specified by a cross-section that is defined by an array of three parameters of the object. Using the printing head to print includes controlling the parallel rows of printing nozzles taking into account pixel density to be achieved in the printed image, setting a printing density of a printing nozzle with regard to at least one reference parameter, and setting a variable offset between a pair of the rows of nozzles based on a change in relative speed between the printing head and the conically rotationally symmetrical region of the object.

Practices of the invention also include those in which image data representative of the printed image is adapted to the conically rotationally symmetrical region, those in which information indicative of a shape of the conically rotationally symmetrical region is received, and those in which pixel density is adapted to a circumference of the conically rotationally symmetrical region.

Some practices include the additional step of generating image data to save the printed image in digital form.

Other practices include arranging the printing head parallel to a secant that corresponds to outer points of the printing region, which is on a curved rotationally symmetrical surface, and arranging the printing nozzles parallel to the region of the curved rotationally symmetrical surface.

Yet other practices include arranging the printing head parallel to a secant that corresponds to an angle of inclination and a distance to the rotationally symmetrical region, which is on a curved rotationally symmetrical surface, and arranging the printing nozzles parallel to the region of the curved rotationally symmetrical surface.

Also included within the scope of the invention are those practices that include rotating the object about an angle of rotation of the rotationally symmetrical region, those that include rotating the object about an angle of rotation of the rotationally symmetrical region at a constant angular velocity, and those that include rotating the object about an angle of rotation of the rotationally symmetrical region with zero angular acceleration.

In some practices, there is the additional step of triggering printing of a line of the printing image at regular rotational distances. Among these are practices that include causing a control unit to transfer signals indicative of rotational increments for use in the triggering of the printing of a line of the printing image.

Other practices include, before printing the image, determining the parameters of the region by measuring.

Yet other practices include selecting the object to be a container or to be a bottle.

In another aspect, the invention features an apparatus including a printing head. The printing head has at least two straight rows that are arranged parallel to each other. Each of the rows includes printing nozzles and is configured to print a printed image on a surface that is a rotationally symmetrical region or a conically rotationally symmetrical region of an outer wall of an object. A variable offset between the at least two straight rows is based on a change in relative speed between the printing head and the region or surface.

In some embodiments, the region is specified by at least three parameters that are indicative of an angle of inclination, a minimum diameter, and a maximum diameter. The apparatus also includes a control unit that is programmed and configured to control the at least two straight rows of printing nozzles arranged parallel to each other. In doing so, the control unit takes account of a pixel density to be achieved in the printed image. The control unit also sets printing density of each printing nozzle based at least in part on at least one of the three parameters.

Other embodiments include a drive unit including a rotary plate, a rotary drive, and a bracket for the printing head. In operation, the rotary plate secures the object, the rotary drive sets the object into rotation, and the bracket positions the printing head relative to the object.

Another embodiment further includes a control unit that has a central processing unit. This central processing unit is configured to execute instructions for controlling the parallel rows of printing nozzles taking into account pixel density to be achieved in the printed image, instructions for setting a printing density of a printing nozzle with regard to at least one reference parameter, and instructions for setting a variable offset between a pair of the rows based on a change in relative speed between the printing head and the conically rotationally symmetrical region of the object In another aspect, the invention features a manufacture that includes a tangible and non-transitory computer-readable medium having encoded thereon software for using a printing head that includes straight parallel rows of printing nozzles to print a printed image on a surface of a conically rotationally symmetrical region of an outer wall of an object, wherein the conically rotationally symmetrical region is specified by a cross-section, wherein the cross section is defined by an array of three parameters of the object, wherein the object is a bottle, wherein software for using the printing head includes instructions for controlling the parallel rows of printing nozzles taking into account pixel density to be achieved in the printed image, instructions for setting a printing density of a printing nozzle with regard to at least one reference parameter, and instructions for setting a variable offset between a pair of the rows based on a change in relative speed between the printing head and the conically rotationally symmetrical region of the object.

It is clear that the aforesaid characteristics and those yet to be explained can be used not only in the particular combination specified, but also in other combinations or alone, without leaving the scope of the present invention.

BRIEF DESCRIPTION OF THE DRAWINGS

Further developments and benefits of the invention arise also from the following descriptions of embodiments of the invention and from the corresponding drawings in which.

Figure 1:
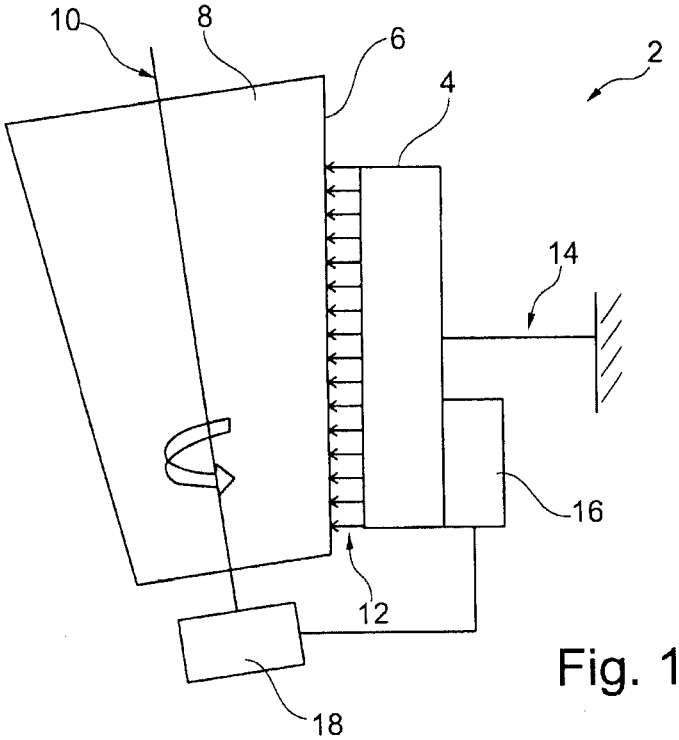
FIG. 1 shows, in a schematic representation, a first embodiment of an arrangement according to the invention.

The invention is illustrated schematically in the drawings by means of forms of embodiments and is described in detail below by reference to the drawings.

The figures are described in connection with each other and about them all, and the same reference symbols designate the same components.

DETAILED DESCRIPTION

In one embodiment, an arrangement 2, shown schematically in FIG. 1, comprises a printing head 4 that has two rows of printing nozzles with which ink 12 is applied onto a surface of a rotationally symmetrical region 6 of an outer wall of an object 8 that rotates about an axis of rotation 10. The printing head 4 is secured on a bracket 14 that positions the printing head 4 relative to the surface 6 of the object 8. A control unit 16 controls and thus guides the printing head 4 and/or adjusts the functions of the printing head 4. This control unit 16 connects to a drive unit 18 on which the object 18 is arranged and, usually, secured such that it can rotate around its axis of rotation 10.

Figure 2:
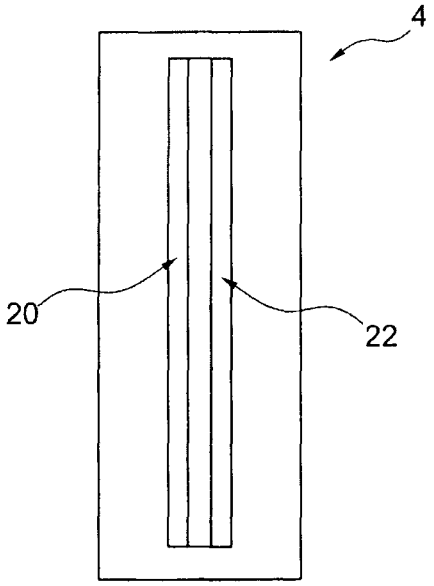
FIG. 2 shows, in a schematic representation, an example of a printing head.

FIG. 2 shows another perspective of the printing head 4. As shown in FIG. 2, the printing head 4 has two rows 20, 22 that are arranged parallel to each other. Each of these rows 20, 22 has a plurality of printing nozzles, arranged equidistant to each other. These nozzles spray or apply ink onto the surface of the region 6 of the object 8.

Figure 3:
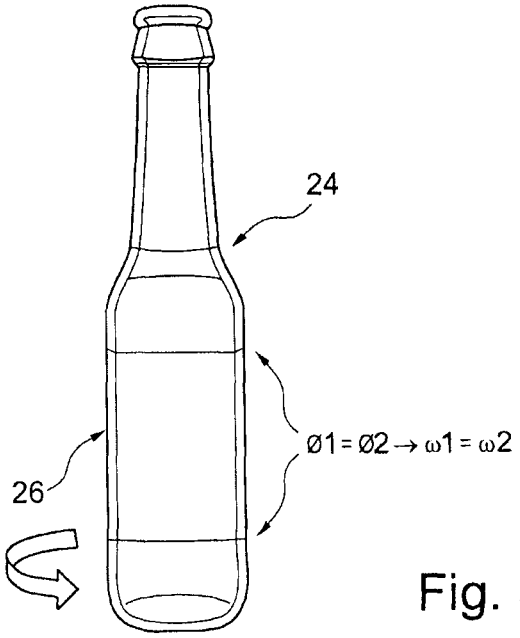
FIG. 3 shows, in a schematic representation, an example of a bottle.

FIG. 3 shows one example of a rotationally symmetrical object with a cylindrical surface 26, namely a bottle. When this bottle 24 rotates at a constant angular speed, all points of the cylindrical surface 26 of the bottle 24 have the same tangential velocity. This is because they are all at the same distance from the bottle's axis of rotation of the bottle 24.

Figure 4:
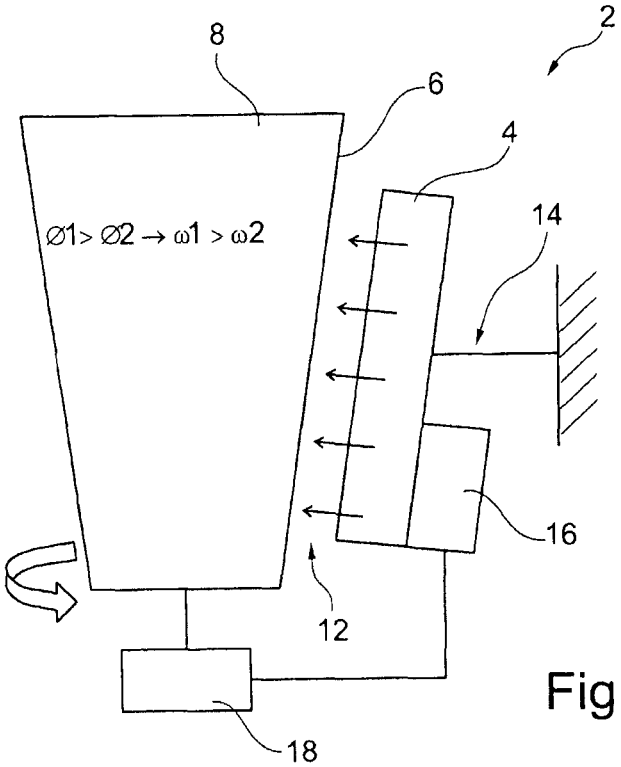
FIG. 4 shows, in schematic form, the first embodiment of the arrangement according to the invention from FIG. 1 in a second perspective.

As FIG. 4 shows, this is not the case when the object 8 has a conically rotationally symmetrical region 6. In the case of a conical object rotated at constant angular velocity, those points of the region 6 of the surface that are further from the axis of rotation 10 will have a higher tangential velocity than those points of the region 6 on the surface which are at closer to the axis of rotation 10.

FIG. 4 also shows that the two rows 20, 22 of printing nozzles of the printing head 4 span the complete height or vertical extension of the printed image to be printed on the region 6. Accordingly it is possible for the printing head 4 to print the printed image on the region 6 after a complete revolution of the object 8.

Figure 5:
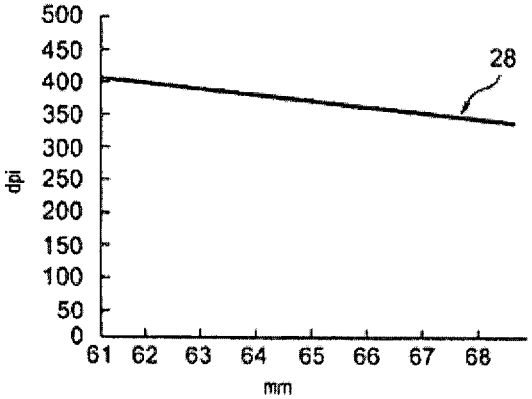
FIG. 5 shows, in a schematic representation, a graph used in an embodiment of the method according to the invention.

Account is taken of this situation in an embodiment of the method according to the invention. In this regard, reference is made to the graph in FIG. 5. The graph's horizontal axis shows a diameter of the rotationally symmetrical region 6 of the object 8. The vertical axis shows printing density in dpi. There thus arises in the graph an application of a printing intensity depending on a particular pressure gauge that results when points of the region 6 are printed with ink from the printing head 4. It is provided furthermore that all the printing nozzles of the printing head 4 are at the same distance to the surface of the conically rotationally symmetrical region 6 of the object 8 so that the two rows 20, 22 of the printing head 4 are arranged parallel to the rotationally symmetrical region 6. Because of the different tangential speeds along the surface of the rotationally symmetrical region 6, there arises the course 28, represented in FIG. 5 by a straight line, of the printing density depending on the pressure gauge.

Figure 6:
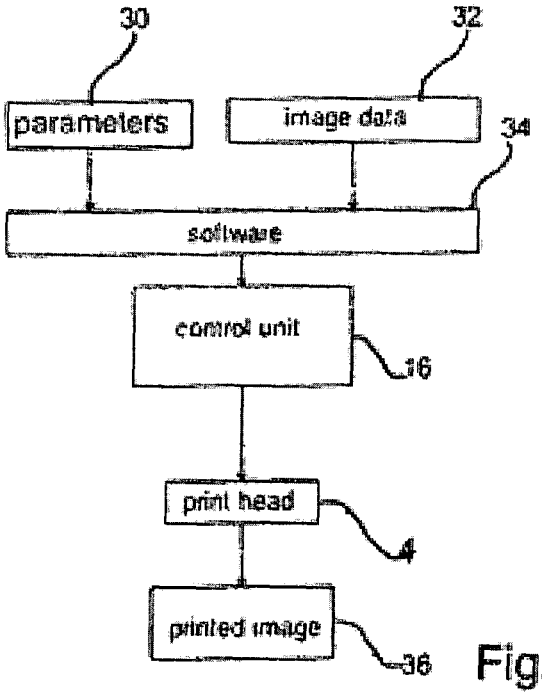
FIG. 6 shows a flow chart for a first embodiment of the method according to the invention.

FIG. 6 illustrates a first embodiment in which image data 32 and parameters 30 are provided to prepress management software 34. The image data 32 includes information for a printed image 36. The parameters 30 describe a rotationally symmetrical region 6 of an outer wall of an object. In some practices, the parameters 30 represent surface parameters, such as an angle of inclination and minimum and maximum diameters of the region 6.

The prepress management software 34 controls a preliminary printing stage of the printed image 36. Furthermore, the prepress management software 34 provides these operating parameters for controlling a printing head to a control unit 16. The control unit 16 uses these parameters to control the printing head 4. The printing head 4 then prints on the surface 6. The resulting output is the printed image 36.

Figure 7:
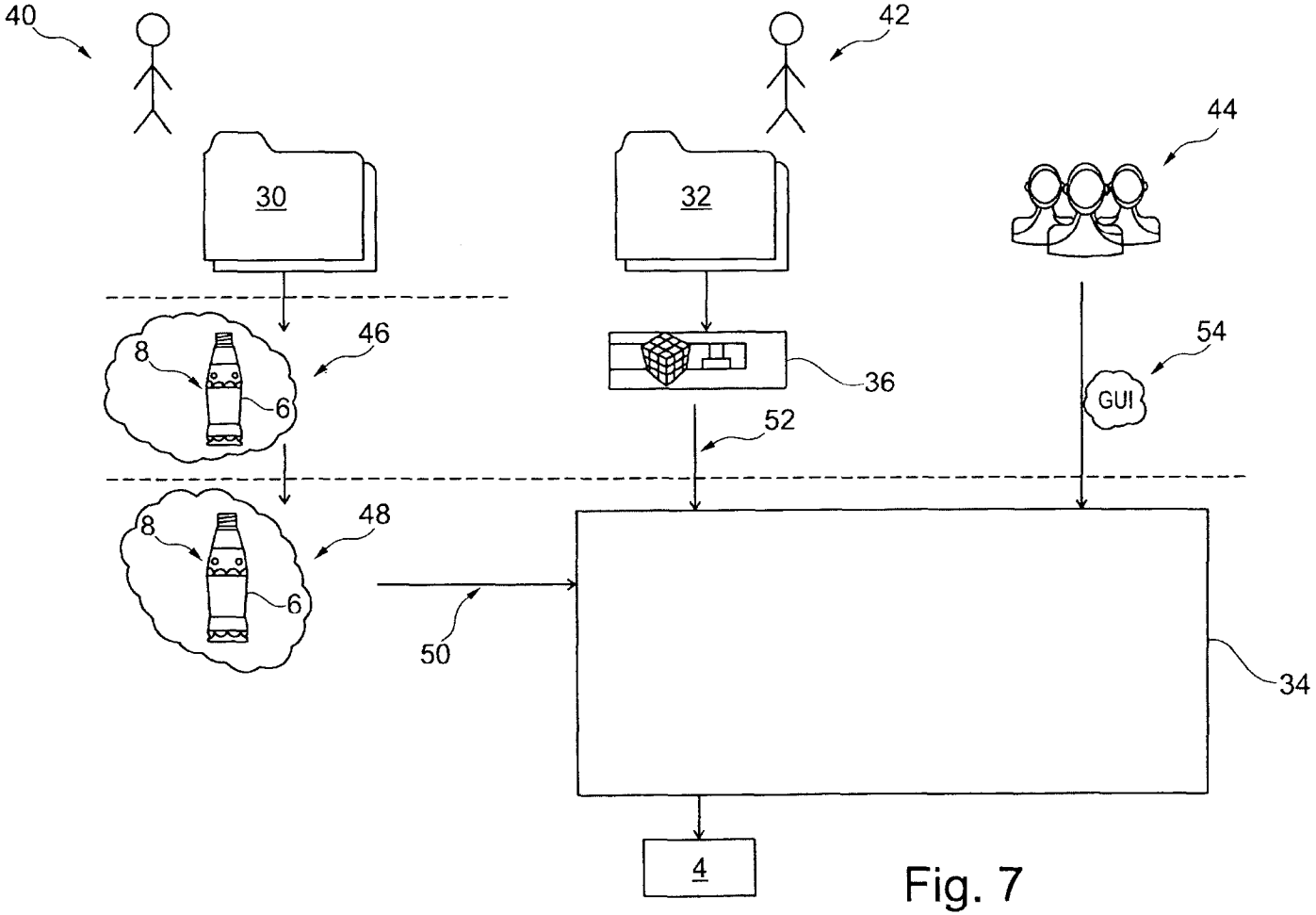
FIG. 7 shows a flow chart for a second embodiment of the method according to the invention.

FIG. 7, which illustrates a second embodiment of the method according to the invention, schematically shows a first designer 40, who designs a shape of the rotationally symmetrical region 6 of the outer wall of the object 8, a second designer 42, who designs the printed image 36, and a user 44.

In FIG. 7, the first designer 40 provides parameters 30 that describe the conically rotationally symmetrical region of the outer wall of the object 8. These parameters 30 are transformed into a pixel graphic 46 that corresponds to a physical resolution of the printing head 4. Furthermore, a position 48 on the printed image 36 is defined. This position 48 comprises, for example, a distance between the printed image 36 and an opening or a base of the object 8, which in the illustrated embodiment is a bottle.

The second designer 42 provides the necessary image data 32. The printed image 36 comprises this image data, for example in the form of a rectangular matrix corresponding to the image's rectangular dimensions. Thus, both information 50 about the shape of the region 6 of the object 8 to be printed upon and information 52 about the printed image 36 are provided to the prepress management software 34. Using a graphical user interface 54, the user 44 can enter, into the prepress management software 34, any additional parameters about the provision of the printed image 36.

The prepress management software 34 is configured to adapt dimensions of the printed image 36 to a surface and a position on the region 6 to be printed upon. In one practice, the prepress management software 34 shifts the image lines of the printed image 36 corresponding to the information 50 about the shape of the region 6 to compensate for a constant offset between the rows 20, 22 of the printing nozzles of the printing head 4. In another practice, individual pixels of the printed image 36 are shifted if the offset should exceed a normal distance of the pixels. Thus, it is not necessary to control each individual printing nozzle to shift points of ink by an offset. Moreover, the prepress management software 34 also controls splitting of the color channels and adapting a droplet size of ink droplets by increasing or decreasing the intensity of the particular pixels of the patterns. The droplet size and/or droplet density is normally adapted to the particular circumstances. In addition, the prepress management software 34 calculates a position of the printing head 4. In one practice, the prepress management software 34, which again provides operating parameters for its operation to the printing head 4, is run in the control unit 16.

Figure 8:
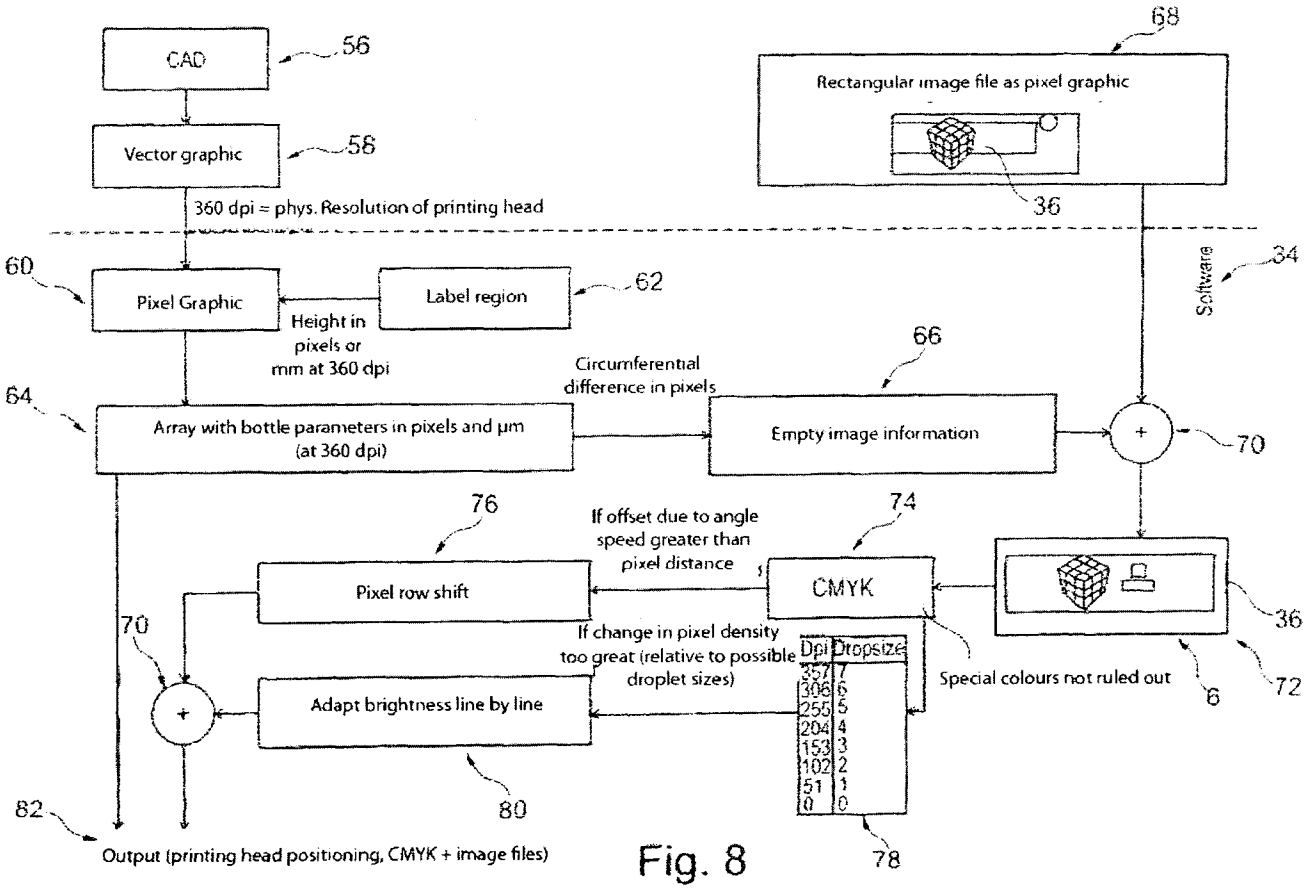
FIG. 8 shows a flow chart for a third embodiment of the method according to the invention.

FIG. 8 illustrates a third embodiment in which one surface of a rotationally symmetrical region 6 of an outer wall of a bottle is printed upon with a printed image 36. In this embodiment, CAD software 56 provides a vector graphic 58. From this vector graphic 58, the prepress management software 34 calculates a pixel graphic 60. Thus, information is provided about a label region 62 and thus the region 6 that is to be printed upon or labeled with the printed image 36.

Taking account information about the label region 62, information about an array 64 with parameters of the object 8 formed as a bottle is provided from the pixel graphic 60. From the array 64, empty image information 66 is generated and merged 70 with image data 68 of an image file, which in this case is a rectangular image file, that exists as a pixel graphic. From this, a specification 72 for the printed image 36 on the region 6 is provided. From this in turn, CMYK information 74 is determined. From the CMYK information, a pixel row shift 76 and thus an offset can be determined. The CMYK information 74 is here designed such that special colors can also be taken into account. Moreover, an allocation 78 of a printing density to a droplet size is taken into account. From this, in turn a line-by-line adaptation 80 of a medium brightness is derived. As a result, the prepress management software 34 provides an output 82 comprising the array 64 and a merging 70 of the pixel row shift 76 with the line-by-line adaptation 80.

In the method for printing on a surface of a rotationally symmetrical region 6 of an outer wall of an object 8 with a printed image 36, at least three parameters 30 specify the region 6. In particular, the parameters 30 specify an angle of inclination and a minimum and a maximum diameter.

The printing head 4 comprises two straight and parallel rows 22, 24 of printing nozzles. The two rows 22, 24 of printing nozzles are controlled taking account a pixel density to be achieved in the printed image 36. A printing density in each case of a printing nozzle is set depending at least on one of the three parameters 30.

With the method, a linear offset is set between printing densities of the printing nozzles of the two rows 22, 24 arranged parallel to each other. The offset is set depending on the pixel density to be achieved. In one practice, the linear offset is set depending on the maximum and minimum diameter of the region 6.

The prepress management software 34 generally controls execution of the foregoing methods. In one practice, the printed image 36 is saved digitally, for example, as image files having image data 32, 68 adapted to the parameters of the region.

The printing head 4 is arranged according to the angle of inclination of the rotationally symmetrical region 6. The rows 22, 24 of nozzles are arranged parallel to the region 6 of the surface.

To print on its surface, the object 8 is rotated about an axis of rotation 10 of the rotationally symmetrical region 6. In some practices, the region 6 is rotated at a constant angular speed.

As the prepress management software 34 causes the control unit 16 to control the printing head 4, signals for rotational increments are transferred. This triggers printing of a line of the printed image 36 at regular rotational distances.

The parameters 30 of the rotationally symmetrical region can be determined by measuring before printing. Alternatively or additionally, these parameters 30 are provided in digitized form.

The illustrated arrangement 2 features the printing head 4 and the control unit 6, which is made to control the two rows 22, 24 of printing nozzles that are arranged parallel to each other taking into account a pixel density of the printed image 36 to be achieved, and to set a printing density in each case of one printing nozzle depending at least on one of the three parameters 30, which in some practices are surface parameters.

The illustrated arrangement 2 also includes a drive unit 18 with a rotary plate for the object 8 and a bracket 14 for the printing head 4. The rotary plate secures the object 8. When made to rotate, the rotary plate also rotates the object 8. The bracket 14 positions the printing head 4 relative to the object 8.

The control unit 16 has a central processing unit that runs the prepress management software 34 for carrying out the foregoing methods.

The invention claimed is:

1. A method of printing on a conical portion of an object, said method comprising using a printing head that comprises straight parallel rows of printing nozzles to print a printed image on a surface of a conically rotationally symmetrical region of an outer wall of said object, wherein said conically rotationally symmetrical region is specified by a cross-section, wherein said cross section is defined by an array of three parameters of said object, wherein using said printing head to print comprises controlling said parallel rows of printing nozzles taking into account pixel density to be achieved in said printed image, setting a printing density of a printing nozzle with regard to at least one reference parameter, and setting a variable offset between a pair of said rows of nozzles based on a change in relative speed between said printing head and said conically rotationally symmetrical region of said object.

2. The method of claim 1, further comprising rotating said object about an angle of rotation of said rotationally symmetrical region.

3. The method of claim 1, further comprising adapting image data representative of said printed image to said conically rotationally symmetrical region.

4. The method of claim 1, further comprising receiving information indicative of a shape of said conically rotationally symmetrical region.

5. The method of claim 1, further comprising adapting said pixel density to a circumference of said conically rotationally symmetrical region.

6. The method of claim 1, further comprising generating image data to save said printed image in digital form.

7. The method of claim 1, further comprising arranging said printing head parallel to a secant that corresponds to outer points of said printing region, which is on a curved rotationally symmetrical surface, and arranging said printing nozzles parallel to said region of said curved rotationally symmetrical surface.

8. The method of claim 1, further comprising arranging said printing head parallel to a secant that corresponds to an angle of inclination and a distance to the rotationally symmetrical region, which is on a curved rotationally symmetrical surface, and arranging said printing nozzles parallel to said region of said curved rotationally symmetrical surface.

9. The method of claim 1, further comprising rotating said object about an angle of rotation of said rotationally symmetrical region at a constant angular velocity.

10. The method of claim 1, further comprising triggering printing of a line of said printing image at regular rotational distances.

11. The method of claim 10, further comprising causing a control unit to transfer signals indicative of rotational increments for use in said triggering of said printing of a line of said printing image.

12. The method of claim 1, further comprising, before printing said image, determining said parameters of said region by measuring.

13. The method of claim 1, further comprising selecting said object to be a container.

14. The method of claim 1, further comprising selecting said object to be a bottle.

15. The method of claim 1, further comprising rotating said object about an angle of rotation of said rotationally symmetrical region with zero angular acceleration.

16. An apparatus comprising a printing head, wherein said printing head comprises at least two straight rows that are arranged parallel to each other, wherein each of said rows comprises printing nozzles, wherein each of said rows is configured to print a printed image on a surface, wherein said surface is selected from the group consisting of a rotationally symmetrical region and a conically rotationally symmetrical region of an outer wall of an object, wherein a variable offset between said at least two straight rows is based on a change in relative speed between said printing head and said region.

17. The apparatus of claim 16, wherein said region is specified by at least three parameters, wherein said at least three parameters comprise parameters indicative of an angle of inclination, a minimum diameter, and a maximum diameter, wherein said apparatus further comprises a control unit that is programmed and configured to control said at least two straight rows of printing nozzles arranged parallel to each other taking account of a pixel density to be achieved in said printed image, and to set a printing density of each printing nozzle based at least in part on at least one of said three parameters.

18. The apparatus of claim 16, further comprising a drive unit comprising a rotary plate, a rotary drive, and a bracket for said printing head, wherein, in operation, said rotary plate secures said object, said rotary drive sets said object into rotation, and said bracket positions said printing head relative to said object.

19. The apparatus of claim 16, further comprising a control unit, wherein said control unit comprises a central processing unit that is configured to execute instructions for controlling said parallel rows of printing nozzles taking into account pixel density to be achieved in said printed image, instructions for setting a printing density of a printing nozzle with regard to at least one reference parameter, and instructions for setting a variable offset between a pair of said rows based on a change in relative speed between said printing head and said conically rotationally symmetrical region of said object.

20. The apparatus of claim 16, wherein said at least two straight rows that are arranged parallel to each other comprise a first row that extends along a first line and a second row that extends along a second line, wherein said first line and said second line are parallel to each other, wherein every line that is perpendicular to said first line and that passes through a point in said first row also passes through a point in said second row.

21. The apparatus of claim 16, wherein said at least two straight rows that are arranged parallel to each other are side-by-side.

22. A manufacture comprising a tangible and non-transitory computer-readable medium having encoded thereon software for using a printing head that comprises straight parallel rows of printing nozzles to print a printed image on a surface of a conically rotationally symmetrical region of an outer wall of an object, wherein said conically rotationally symmetrical region is specified by a cross-section, wherein said cross section is defined by an array of three parameters of said object, wherein software for using said printing head comprises instructions for controlling said parallel rows of printing nozzles taking into account pixel density to be achieved in said printed image, instructions for setting a printing density of a printing nozzle with regard to at least one reference parameter, and instructions for setting a variable offset between a pair of said rows based on a change in relative speed between said printing head and said conically rotationally symmetrical region of said object.

* * * * *